US005730827A

United States Patent [19]

Sewell

[11] Patent Number: 5,730,827

[45] Date of Patent: Mar. 24, 1998

[54] TAPER

[75] Inventor: Peter Clive Sewell, Vancouver, Canada

[73] Assignees: Dekka Industries Inc.; Sidewinder Technologies Inc., both of Vancouver, Canada

[21] Appl. No.: 572,753

[22] Filed: Jul. 20, 1995

[51] Int. Cl.[6] ..... B31B 1/72

[52] U.S. Cl. ..... 156/269; 156/468; 156/475; 156/486; 156/522; 53/136.4

[58] Field of Search ..... 156/475, 468, 156/483, 484, 485, 486, 212, 213, 516, 517, 518, 522, 477.1, 530, 580, 269; 53/136.4, 419

[56] References Cited

U.S. PATENT DOCUMENTS

| | | | |
|---|---|---|---|
| 3,614,849 | 10/1971 | Croucher | 53/419 X |
| 3,676,266 | 7/1972 | Jensen et al. | 156/521 |
| 3,868,291 | 2/1975 | Benz et al. | 156/530 X |
| 4,069,093 | 1/1978 | Linner | 53/136.4 X |
| 4,227,955 | 10/1980 | Woods et al. | 156/530 X |
| 4,415,399 | 11/1983 | Geisinger | 156/475 |
| 4,708,761 | 11/1987 | Taniguchi et al. | 156/516 |
| 4,869,769 | 9/1989 | DiRusso, Jr. et al. | 156/475 X |

*Primary Examiner*—James Engel
*Attorney, Agent, or Firm*—C. A. Rowley

[57] ABSTRACT

A tape applying mechanism employs a puller having a gripper that grips the free end of a tape and then pulls it from a pickup position along a path into an extended position. A pressure bar then moves across the path and forces the tape against the surface of an article, preferably the pressure bar will include a pair of end wipers to wipe end sections of the tape along a pair of sides of the article in a direction substantially perpendicular to the first or major surface of the article. The device is particularly suited for applying a sealing tape to a carton wherein the side of the tape facing the article or carton has an adhesive surface.

15 Claims, 3 Drawing Sheets

TAPER

FIELD OF INVENTION

The present invention relates to a tape applying mechanism, more particularly, the present invention relates to a reciprocating head—tape applying mechanism.

BACKGROUND OF THE INVENTION

The equipment for applying tape, for example, for closing cartons, varies from simple hand-held devices to relatively complicated automatic tapers that apply tape generally as a carton is traveling along a path.

In simple manually operated devices, a roll of tape is mounted on a spindle and positioned with a free end of the tape protruding from the roll. The free end of the tape is applied against and adhered to the surface of the carton or article being taped by a wiper portion of a hand-held device and as the device is drawn along the surface of the carton, tape is dispensed under tension from the roll. In many of these devices, a cut-off knife is provided so that by changing the orientation of the device, a cutting blade is brought across the path of the tape immediately tracking the wiper in a position to provide the protruding free end of the tape. With these devices a random length of the tape is applied by a pressing the free end of the tape against the carton and then via a drawing motion of a hand the tape is applied under tension against the carton and the tape is the cut to produce a protruding free tape end by a twisting motion of the hand.

In most tape applicators for applying tape automatically or semi-automatically to articles or carton, a taping head incorporating a plurality of a spring biased rollers which press the tape against the carton to first stick the free end of the tape to the carton and then by relative motion between the article and the tape applicator applies the tape under tension and presses the tape to the article. In most of these roller applicators a suitable cut-off mechanism is automatically actuated, when an end of the article being taped is sensed, to cut off the required length of tape after it is applied by the applicator and to position a free end of the tape in the proper position to be applied to the next article to be taped.

In most of these tapers, the tape is a suitable plastic film strip having adhesive coating on one surface. Generally a pressure sensitive adhesive is used, however, it is also possible to coat the adhesive to the tape as it is applied or to use a preapplied adhesive that is activated by some means, for example, by heat or moisture immediately prior to the application step.

There seems to be no device available that is suitable for mechanized taping of articles wherein the article is stationary during taping and movement of the operator for loading and unloading is not essential.

In the above described tape applicators relative movement between the carton and the tape applicator is required to dispense the tape from the applicator which in may instances requires the cannon to be moved away from the operator during taping and thus requires extra movement or a second operator to handle the taped carton.

BRIEF DESCRIPTION OF THE PRESENT INVENTION

It is an object of the present invention to provide a tape dispensing and applying mechanism for pulling a tape from a source prior to application.

It is a further object to provide a mechanized taper wherein the canon or article being taped may be stationary during the taping operation.

Broadly, the present invention relates to a taping mechanism for applying tape to an article comprising a source of tape, a retainer, a tape gripping means, means for reciprocating said gripping means along a path between a pickup position and an extended position spaced from said pickup position, means to open and close said gripping means, a pressure bar having a tape pressing surface, means for reciprocating said pressure bar across said path to press a tape onto one surface of said article after said gripping means has pulled a free end of said tape from said pickup position to said extended position so that a length of tape extends along said path.

Preferably, said pressing surface comprises a layer of compressible material which substantially uniformly applies pressure to the tape.

Preferably, said mechanism will further comprise end wiper means to wipe an end section of said tape onto at least one second surface of said article, said second surface extending at an angle from one end of said one surface.

Preferably, two said wiper means are provided, one adjacent to each end of said article, each of said wiper means wiping an adjacent end section of said tape onto an adjacent second surface of said article.

Preferably, said second surface and one surface are substantially perpendicular and said wiper means is positioned to apply pressure to said article in a direction substantially perpendicular to the direction of movement of said pressure bar across said path.

Preferably, cut-off means will be provided for automatically cutting off said tape adjacent to said retainer means but spaced sufficiently therefrom to form a free tape end spaced from said retainer means to provide an extended tape portion to be gripped by said gripping means.

Preferably, said means to grip will comprise an anvil and a pressure member, said pressure member having a polygonal cross section, means mounting said member for rotation about its polygonal axis, means for pressing said member towards said anvil to press an axial surface of said member towards said anvil and clamp a tape therebetween with an adhesive surface of said tape facing said axial surface of said polygon.

Preferably, said means for pressing said member toward said anvil will apply resilient pressure so that a pulling action of said tape through its adhesive connection with said axial polygon surface can cause said member to rotate about said polygonal axis and release said tape.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
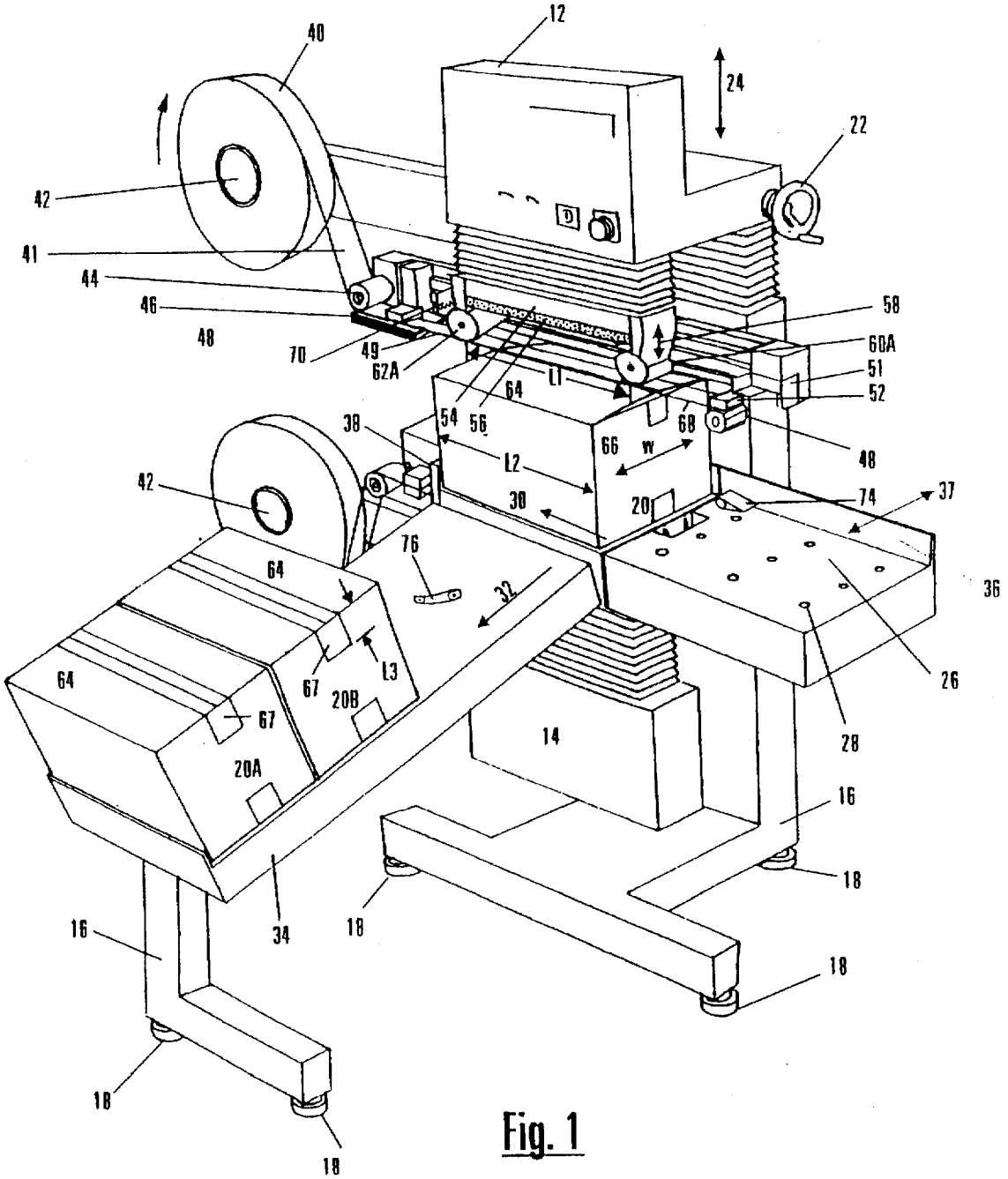
FIG. 1 is an isometric schematic illustration of the present invention illustrating a selected application of the present invention.

As shown schematically in FIG. 1, the present invention relates to a tape applicator 10 which in the illustrated arrangement is in an application incorporating two tape applicators 12 and 14 each constructed in accordance with the present invention, one (12) for applying tape to the top and one (14) to apply tape to the bottom of an article 20, which in the illustration is shown as a carton. In this arrangement, the top and bottom applicators are essentially the same and thus, only one will be described it being understood that the second applicator will be essentially the same as the first but inverted.

In this illustrated arrangement, the applicators are mounted on a frame 16 that is leveled using leveling pads 18.

The base position of the upper tape applicator is vertically adjusted for taping different size articles, such as the carton 20 (or any article that is to be taped). This adjustment is attained in the illustrated arrangement by manipulating the hand wheel 22 that causes the whole taping unit 12 to move vertically as indicated by the arrow 24. Any suitable known mechanism may be used for this purpose. The taper may also be made adjustable to accommodate articles of different lengths and widths as will be described below.

The bottom applicator 14 need not be movable since it applies tape to the bottom of the article 20 and in the illustrated arrangement the bottom of the article is always in the same plane resting on the feed table 26. The feed table 26 preferably is provided with suitable bearings or the like 28 to facilitate movement of the article 20 into the taping station or position as illustrated, i.e. by movement in the direction of the arrow 30. After taping, the article 20, in the illustrated arrangement, is then moved in the direction of the arrow 32 onto the chute 34 from which the taped articles 20A or 20B may be removed by any suitable means for example, manually.

It will be apparent that the present invention may be applied to anyone of a number of different packing table arrangements, for example, instead of feeding in the direction of the arrow 30, the elements may be fed in the reverse direction to the arrow 32 and removed in any selected direction, for example, in the direction of the arrow 32 or its reverse, or of the arrow 30 or its reverse direction, etc. However, it is important that one end and one side of the article be reasonably accurately positioned relative to the tape path to ensure that the tape is applied where required. This is attained in the present illustration by the positions of guide bar 36 and the stop 38 both of which may be made adjustable as will be described below.

Each of the tape applicators 12 and 14 includes a tape source in the form of a roll of tape 40 mounted tape on a shaft 42 that resists unwinding of the tape 41 from the roll 40 so that the tape 41 is maintained under tension. The tape 41 passes from the tape roll 40 onto the guide roll 44 and is pressed against a retaining surface formed on the element 46. This retained surface on element 46 is preferably a textured surface roughened to lessen the adhesion of pressure sensitive on the tape to the surface to ensure the tape can be withdrawn.

Figure 2:
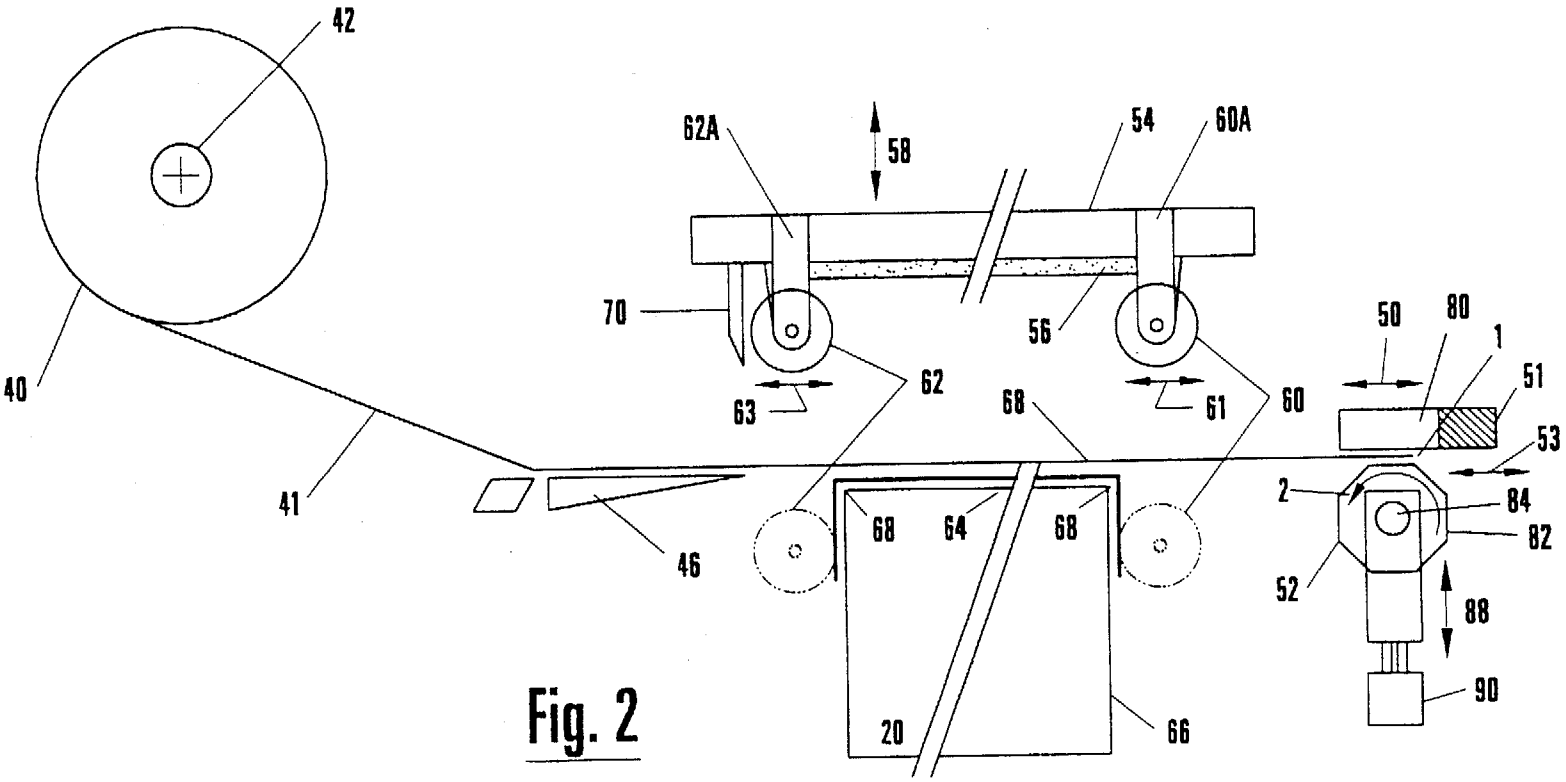
FIG. 2 is a schematic representation of the gripper mechanism of the present invention and schematically illustrating the operation of the invention.

In the dispensing or pulling operation, the tape is gripped, as will be described hereinbelow, by a gripper 48, that is reciprocated as indicated by the arrow 50 (see FIGS. 2, 3 and 4) between a pickup position 49 (FIGS. 1 and 4) adjacent to the retainer 46 to an extended position as indicated 52 in FIGS. 1 and 2. The location of the position 49 is generally fixed relative to the element 46 while the location of the position 52 may be adjusted, for example, by movement of the stop 51 as schematically indicated by the arrow 53 (FIG. 2). Movement of the position 52 is necessary to accommodate different lengths of tape to be pulled as is required when the length of the article to be taped is changed and/or the length of tape wiped along the end of the article is changed as will be described below The reciprocal movement may be applied to the gripper 48 by any suitable means, for example by a magnetic drive wherein a magnetic piston is selectively pneumatically driven along a tube in opposite directions and the gripper is secured to and reciprocates with a tubular mounting sleeve surrounding the tube and magnetically coupled to the magnetic piston.

A presser bar 54 which is preferably provided with a compressible layer 56 forming a pressure applying surface, is reciprocal as indicated by the arrow 58 by a suitable means shown schematically by the arrow 58 from a retracted position (i.e. the solid line position) above the tape path as indicated in FIGS. 1 and 2 to an extended position as shown in part by the dotted line outline of the rollers 60 and 62 in FIG. 2. in the extended position the compressible pad or layer 56 is pressed against the non-adhesive side of the tape 41 to force the adhesive coated side of the tape 41 against the surface of the article 20.

The rollers 60 and 62 serve as wipers for wiping the end sections of the tape 41 i.e. the sections of the tape projecting beyond the surface 64 of the article into face to face relationship with the adjacent sides of the article.

Figure 3:
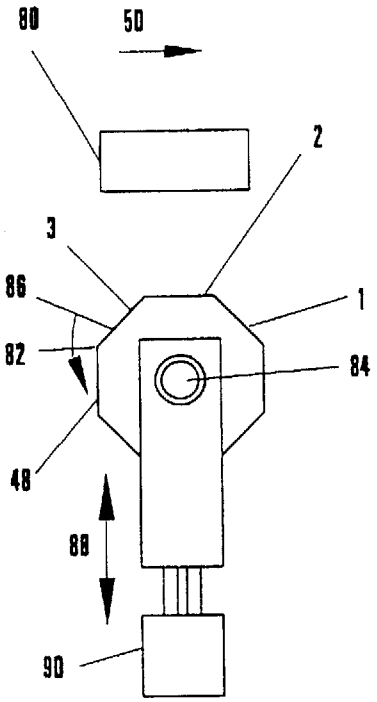
FIG. 3 shows the gripper mechanism in open position reciprocating rearwardly to a position to pick up a leading end of a tape.

In the arrangement shown in FIGS. 2 and 3, the applicator head or bar 54 with the resilient pressure surface layer 56 is provided with rollers 60 and 62 spaced from the surface 56 and adapted to function as wipers for moving the end sections of the tape 41 along the second surface 66 of the article 20 being taped. In FIG. 1, the pressure bar 54 is simply a U-shaped bar having a pair of end wipers 60A and 62A which are fixed and are spaced apart as indicated by the distance $L_1$ which is substantially equal to and preferably slightly less than the length $L_2$ of the article 20 i.e. the length of the first surface 64 against which the tape 41 is to be pressed by the layer 56. The rollers 60 and 62 which form the wipers in the FIGS. 2 and 3 embodiment are positioned in essentially the same manner and function in essentially the same way wipers 60A and 62A in FIG. 1 to apply the end sections of the tape to the second surfaces 66.

Each of the wipers 60 and 62 is preferably adjustable along the length of the bar 54 as schematically indicated by the arrows 61 and 63 (FIG. 2) to apply different tape lengths to different articles as desired and as will be described below.

The tape 41 extends from the roll of 40 and is held on the retainer 46 with an extended portion 43 projecting beyond the retainer 46. This extended portion is gripped by the gripper 48 when the gripper 48 is positioned adjacent to the retainer 46 (pickup position) The gripper 48 is then moved from the position pick up position (where the gripper is indicated at 48) in FIGS. 1 and 4 and the position 52 (extended position) shown in FIGS. 1, 2 and 3. This movement of the gripper 48 pulled the tape 41 along a path extending from the pickup position to the extended position 52 thereby to form an extended length of tape 68 extending from the retainer 46 to the gripper 48 in the extended position 52 see FIGS. 1 and 2. With the tape so positioned, the pressure bar 54 is lowered, which, if end wipers 60 and 62 (or 60A and 62A) are provided, first moves the end wipers 60, 62 or 60A and 62A along the adjacent side of the article 20 to force the tape to bend around the edges of the article 20 and apply the end sections of the tape 41 along the surfaces 66 (see FIGS. 2 and 3) and eventually to move the compressible pressure surface 56 against the tape extending over the main surface 64 of the article 20 and press the tape 41 against that surface. The bending of the tape around the corner 68 of the canon or other article 20, tends to lock the tape in position and relatively tightly, i.e. under significant tension along the surface 64 so the pressure applied by the compressible surface 56 simply presses the tape 41 into the nooks and crannies, if any, of the surface 64 and ensures there is relatively uniform pressure along the full length of the tape 41 applied to the surface 64.

Figure 4:
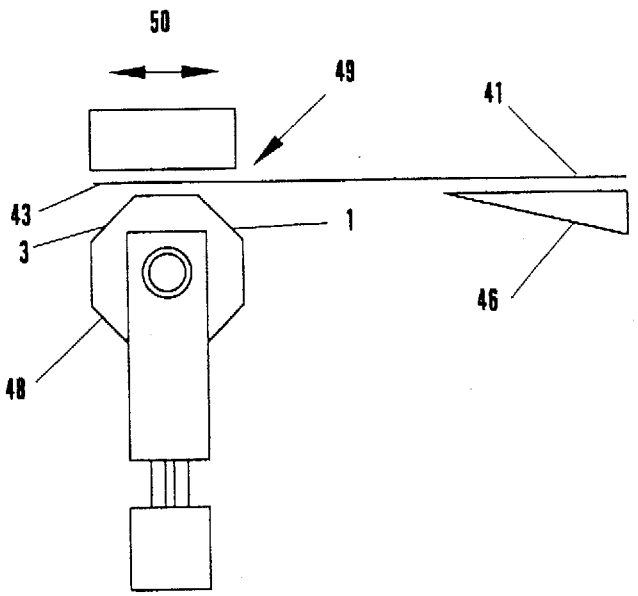
FIG. 4 is a view of the gripper mechanism in pick up position wherein the clamping number has moved against the anvil bar to clamp the tape prior to pulling the tape along a path to an extended position.

As the head 54 is moved to the position shown in FIG. 3, the cutter 70 attached to the head 54 is positioned to sever the tape 41 at a distance spaced from the retainer 46 to leave an extending portion 43 projecting beyond the retainer 46 and in a position to be gripped as shown in FIG. 4 by the gripper 48 when it is moved to the pickup position 49.

As above indicated the taper may be adjusted to accommodate different lengths $L_2$ and widths W articles or cartons 20. Width W is accommodated by moving the guide bar 36 as indicated by the arrow 37. A change in length $L_2$ of the article 20 or of the tape extending along the ends $L_3$ may be accommodated by repositioning of the wipers 60 and 62. Normally only wiper 60 will require movement when the length $L_2$ is changed, but if $L_3$ (length of the wiped on tape end portions 67, see FIG. 1) is to be changed the position of the wiper 62 adjacent to the pick-up position 49 may also require changing together with the positions of the cut-off knife 70 and stop 38. Obviously such changes change the length of tape 41 that must be dispensed and the travel of the head 48 must be adjusted and the location of the stop 53 changed. If desired the length or extension of the wipers in the direction perpendicular to the bar may be changed by any suitable means for example by exchanging the wipers for ones of different length.

The operation of the system is timed by sensing the position of the article 20, by example, a sensor 74 (see FIG. 1) that senses when the article 20 is in position. Generally, this sensor could be a part of the stop 38 if desired. When the article 20 reaches this position, the tape 41 has already been extended to provide the span 68 and the reciprocation of the head 54 is commenced to force the tape 41 onto the end surfaces 66 and wipe on tape end portions 67, cut the tape 41 adjacent to, but spaced from (as described above) retainer 46 and then force the tape 41 against the top span or first surface 64 of the article 20 by the pressure layer 56.

When the head 54 reaches its final destination in the downward direction (or upward direction depending on the orientation and position of the tape head), it is retracted back to the position as shown in FIGS. 1 and 2 and the article 20 is removed. In the arrangement illustrated the article is removed along the path indicated by the arrow 32 and trips the sensor 76 indicating that the article is clear which causes the gripper 48 to move back to its pickup position 49, grip the extended portion 43 and then draw the tape 41 along path 68 by movement of the head 48 to the extended position 52 ready for the next carton or article 20 to be taped.

The gripper 48 is preferably formed by an anvil 80 (see FIGS. 2, 4 and 5) that cooperates with a polygonal cross section presser member 82 (octagonal cross-section in the illustrated arrangement). The polygonal cross section presser member 82 is rotatable about its polygonal axis 84 as indicated by the arrow 86 and is movable from a clamping position shown in FIGS. 2 and 4 to an open position shown in FIG. 3 via preferably a pneumatic pressure means 90 (as indicated by the arrow 88).

The pressure means 90 maintains resilient pressure on the member 82 forcing one of the surfaces 1, 2, etc. of the polygon member 82 against the surface of the anvil 80 to clamp the extended portion 43 of the tape 41 therebetween. The movement of the pressure head 54 forces the portion 43 of the tape 41 from the gripper 48 by rotating the member 82 by movement of the tape 41 as imposed by the presser bar 54. Such rotation causes the member 82 and thus the surface 1 to rotate in the direction of the arrow 86 and release the end 43 of the tape 41 and bring the next surface 2 into position approaching parallel with the face of the anvil 80. The resilient force applied by the pneumatic 90 determines the amount of pressure applied between the anvil 80 and member 82 to retain the end 43 of the tape 41 in the gripper 48 while the rotation of the member 82 tends to reduces the surface area over which pressure is applied between the anvil 80 and member 82 and permit the tape 41 to release from member 82.

In the illustrated arrangement, a single gripper head has been provided with a single tape source 40. If speed is of the essence, it is possible to arrange two of the applicators side by side one operating by pulling the tape 41 in one direction from one source and the other pulling.

I claim:

1. A taping mechanism for applying tape to an article comprising a source of a ribbon of tape, a retainer, a releasable tape gripping means, means for reciprocating said gripping means along a tape path between a pickup position adjacent said retainer and an extended position spaced from said pickup position, means to open and close said gripping means to grip said ribbon of tape adjacent to a leading end of said ribbon of tape and retain said leading end of said ribbon of tape while said means for reciprocating moves gripping means from said pickup position to said extended position so that said ribbon of tape extends under tension along said tape path between said pickup position to said extended position, pressing means mounted adjacent to said tape path between said pickup position and said extended position, said pressing means having a tape pressing surface, means for moving said pressing means across said path between said extended and said pickup positions and adjacent to said pickup position and said extended position to press a potion of said ribbon of tape adjacent to said leading end of said tape against said article and to free said leading end from said gripper means and means to sever said ribbon of tape adjacent to said pickup position.

2. A taping mechanism as defined in claim 1 wherein said pressing means comprises a pressing surface having layer of compressible material which substantially uniformly applies pressure to the tape along a surface of said article.

3. A taping mechanism as defined in claim 1 wherein said pressing means comprises end wiper means adjacent to said extended position, means to move said end wiper means to wipe an end section of said ribbon of tape adjacent to said leading end against said article.

4. A taping mechanism as defined in claim 3 wherein a second wiper means is provided, adjacent to each end of said article, means to move said second wiper means to wipe a second end section of said ribbon of tape onto said article.

5. A taping mechanism as defined in claim 1 wherein said releasable tape gripping means comprises an anvil and a presser member, said presser member having a polygonal cross section, means mounting said member for rotation about its polygonal axis, means for pressing said presser member towards said anvil to press an axial surface of said polygon towards said anvil and clamp said tape therebetween with an adhesive surface of said tape facing said axial surface of said polygon.

6. A taping mechanism as defined in claim 5 wherein said means for pressing said member toward said anvil applies a resilient pressure so that a pulling action of said tape through its adhesive connection with said axial polygon surface causes said member to rotate about said polygonal axis and release said tape.

7. A taping mechanism as defined in claim 4 wherein said releasable tape gripping means comprises an anvil and a presser member, said presser member having a polygonal cross section, means mounting said member for rotation about its polygonal axis, means for pressing said presser member towards said anvil to press an axial surface of said polygon towards said anvil and clamp said tape therebetween with an adhesive surface of said tape facing said axial surface of said polygon.

8. A taping mechanism as defined in claim 7 wherein said means for pressing said member toward said anvil applies a resilient pressure so that a pulling action of said tape through its adhesive connection with said axial polygon surface causes said member to rotate about said polygonal axis and release said tape.

9. A taping mechanism as defined in claim 4 wherein said releasable tape gripping means comprises an anvil and a presser member, said presser member having a polygonal cross section, means mounting said member for rotation about its polygonal axis, means for pressing said presser member towards said anvil to press an axial surface of said polygon towards said anvil and clamp said tape therebetween with an adhesive surface of said tape facing said axial surface of said polygon.

10. A taping mechanism as defined in claim 9 wherein said means for pressing said member toward said anvil applies a resilient pressure so that a pulling action of said tape through its adhesive connection with said axial polygon surface causes said member to rotate about said polygonal axis and release said tape.

11. A taping mechanism as defined in claim 4 wherein said releasable tape gripping means comprises an anvil and a presser member, said presser member having a polygonal cross section, means mounting said member for rotation about its polygonal axis, means for pressing said presser member towards said anvil to press an axial surface of said polygon towards said anvil and clamp said tape therebetween with an adhesive surface of said tape facing said axial surface of said polygon.

12. A taping mechanism as defined in claim 11 wherein said means for pressing said member toward said anvil applies a resilient pressure so that a pulling action of said tape through its adhesive connection with said axial polygon surface causes said member to rotate about said polygonal axis and release said tape.

13. A method of applying tape to an article comprising gripping a leading end of a ribbon of tape having an adhesive on one side thereof extending from a source, pulling said leading end of said ribbon of tape from a pick up position adjacent to said tape source to an extended position to extend a length of said ribbon of tape under tension along a tape path bridging between said pickup position and said extended position spaced from said pickup position, positioning said article to be taped adjacent to said adhesive coated side of said ribbon of tape extending along said tape path bridging between said pickup and said extended positions, pressing said ribbon of tape to force said ribbon of tape from said tape path bridging between said pickup and said extended positions and against said article to secure said tape to said article and to free said leading end from being gripped and severing said ribbon of tape adjacent to said pickup position.

14. A method as defined in claim 13 wherein said pressing comprises wiping a first end portion of said ribbon of tape adjacent to said leading end against said article.

15. A method as defined in claim 14 wherein said pressing further comprises wiping a second end portion of said ribbon of tape adjacent to said pick position against said article.

* * * * *